United States Patent [19]

George

[11] 4,273,354

[45] Jun. 16, 1981

[54] CONVERTIBLE SKI BOOT AND BINDING EQUIPMENT

[76] Inventor: Frederick W. George, P.O. Box 9246, Tahoe Valley Pharmacy, S. Lake Tahoe, Calif. 95731

[21] Appl. No.: 13,380

[22] Filed: Feb. 21, 1979

[51] Int. Cl.[3] ..... A63C 9/08

[52] U.S. Cl. ..... 280/614; 36/50; 36/54; 36/117; 280/618

[58] Field of Search ..... 280/614, 615, 618, 617, 280/635, 611; 36/117, 118, 119, 120, 121, 50, 54

[56] References Cited

U.S. PATENT DOCUMENTS

| | | | |
|---|---|---|---|
| 3,715,127 | 2/1973 | With | 280/615 |
| 3,775,866 | 12/1973 | Marker | 280/615 |
| 4,029,336 | 6/1977 | Haimerl | 280/614 |

FOREIGN PATENT DOCUMENTS

| | | | |
|---|---|---|---|
| 1963342 | 6/1971 | Fed. Rep. of Germany | 36/120 |
| 2363368 | 6/1975 | Fed. Rep. of Germany | 280/614 |
| 81348 | 8/1934 | Sweden | 280/618 |
| 474278 | 8/1969 | Switzerland | 280/614 |

*Primary Examiner*—John J. Love
*Assistant Examiner*—Milton L. Smith
*Attorney, Agent, or Firm*—Flehr, Hohbach, Test, Albritton & Herbert

[57] ABSTRACT

Convertible ski boot and binding equipment is provided for alternate use in different modes of skiing, such as Alpine, tour skiing, or ski mountaineering. For Alpine skiing an outer shell is detachably mounted about an inner ski boot with the toe of the boot latched in a toe binding which includes a toe plate which is adapted to pivot on the ski for quick release. The heel of the shell is releasably held on the ski by a spring-loaded plunger which is mounted in a heel support molded in the shell. For tour skiing the shell and tongue are detached with the heel of the boot free to move from the ski and with the toe latched in the toe plate which in turn is rigidly locked on the ski.

5 Claims, 7 Drawing Figures

CONVERTIBLE SKI BOOT AND BINDING EQUIPMENT

This invention in general relates to ski equipment which is convertible for use in downhill (Alpine), tour skiing (Nordic) and ski mountaineering types of sports activity.

Conventional ski equipment for Alpine or downhill skiing comprises ski boots of unitary construction having a rigid shell of hard plastic on a stiff sole. The bindings for Alpine skiing include different forms of quick release devices for clamping the toe and heel of the boot on the ski with the boot releasing from the ski under high stresses to prevent injury to the skier. Nordic or tour skiing requires substantially different equipment. Thus, the ski boot is relatively smaller, lighter and is flexible so that the skier's foot can bend while striding on the skis. Also the bindings for Nordic equipment differ in that the boot toe is rigidly locked to the ski while the heel is free to move.

Because of the marked differences in skiing techniques conventional equipment for Alpine and Nordic skiing are not interchangeable. That is, it is not feasible to use the hard-shelled downhill ski boots for cross-country skiing, nor is it feasible to use the soft leather Nordic boots for downhill skiing. Previous attempts to provide ski equipment adaptable to the different modes of skiing have not been fully successful. Thus, one suggested design is to provide a rigid ski boot of the Alpine type with a special binding having a platform to which the boot is clamped. In the downhill mode the platform and thereby the boot is clamped flat on the ski while for climbing the rear of the platform is clamped in an elevated position above the ski. Such equipment, however, does not permit true cross-country skiing because the ski boot cannot flex and the heel is held in a fixed position.

Presently available equipment, therefore, requires that a skier use completely separate ski boots and bindings for the different types of skiing. The need has thus been recognized for ski equipment that is easily convertible into different modes for use in downhill or cross-country skiing.

It is a general object of the invention to provide new and improved ski equipment which is convertible for use in different modes of skiing.

Another object is to provide ski equipment which is convertible between Alpine and Nordic modes of use.

Another object is to provide ski equipment of the type described in which for the Alpine ski mode a rigid outer shell of the ski boot is held on the ski by heel and toe bindings which provide quick release.

Another object is to provide ski equipment of the type described in which for the Nordic mode the toe of a flexible boot is rigidly locked to the ski while the heel is free to move. In the Nordic mode the skier can carry the detached shells in a pack on his back.

The invention in summary includes an outer ski boot shell which is detachably mounted about an inner flexible ski boot for use during Alpine skiing. The heel of the shell includes a spring loaded plunger which engages a detent on the ski to provide a heel binding. The toe of the boot is releasably latched to a toe plate which is pivotally mounted on the ski. The toe plate is locked to the ski during the Nordic mode and is released to permit quick release of the toe during Alpine skiing.

Figures 1, 7:
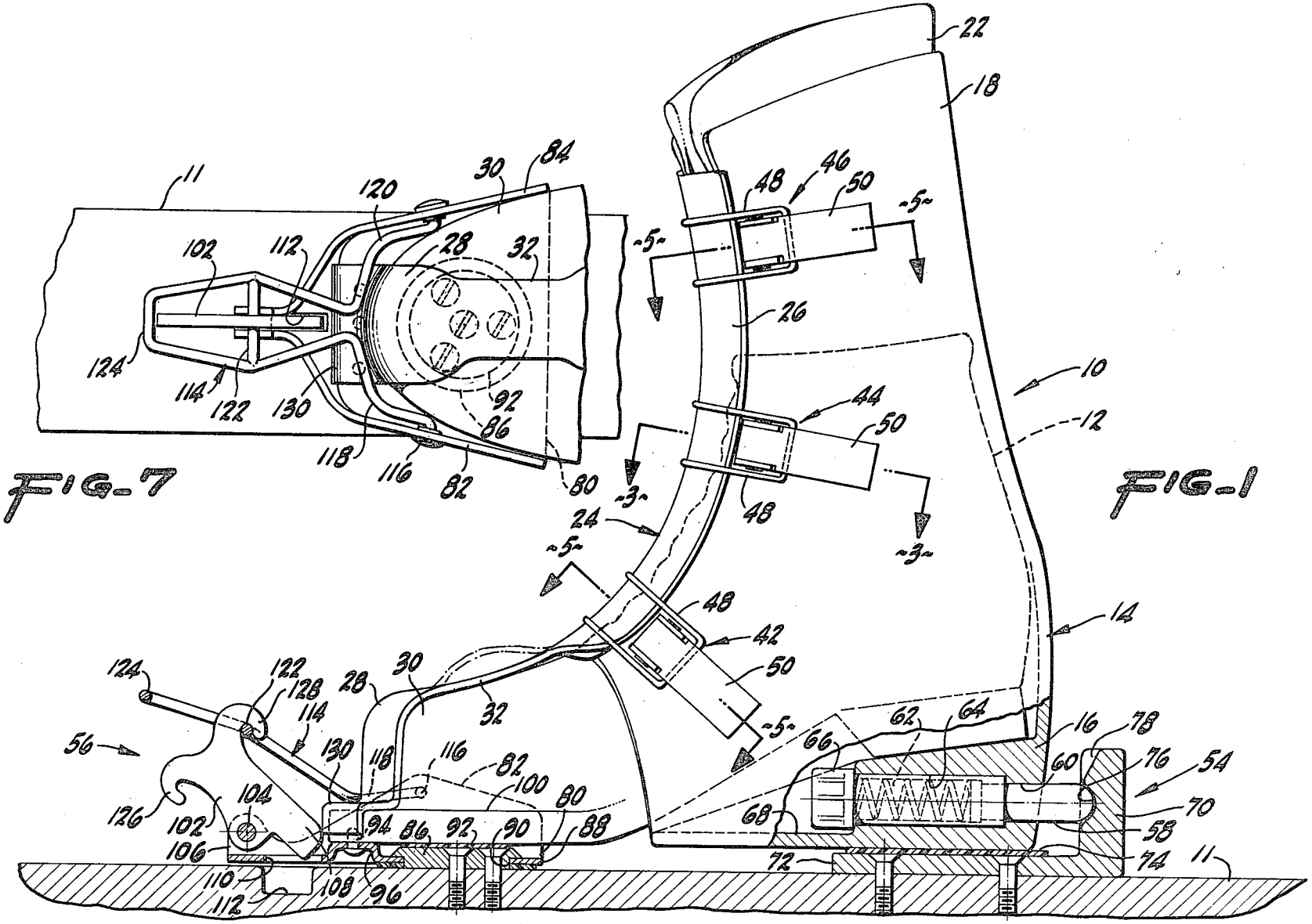
FIG. 1 is a side elevational view, partially cut away, illustrating the ski equipment in the Alpine mode of use.
FIG. 7 is a fragmentary top plan view of the toe binding of FIG. 1.

FIG. 1 illustrates generally at 10 the combination ski boot and binding unit of the invention shown in the mode for Alpine or downhill skiing. Another similar unit, not shown, would be provided for the other foot of the skier. The ski 12 upon which the bindings are affixed can be of the ski mountaineering type with a width and flexibility compatible for use with a variety of terrain and conditions.

Figure 3:
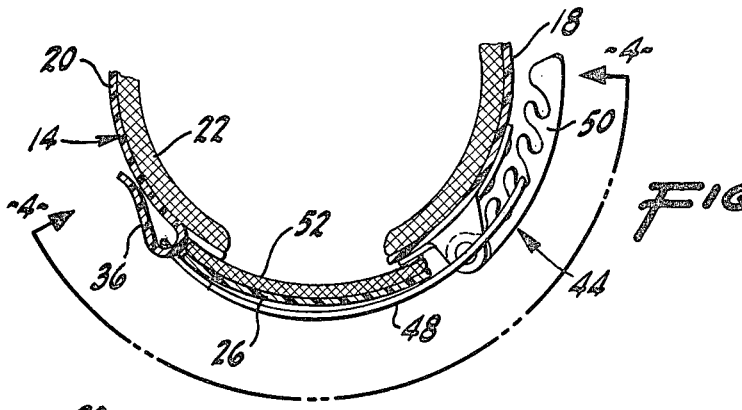
FIG. 3 is a fragmentary cross-sectional view taken along the line 3—3 of FIG. 1.
Figure 4:
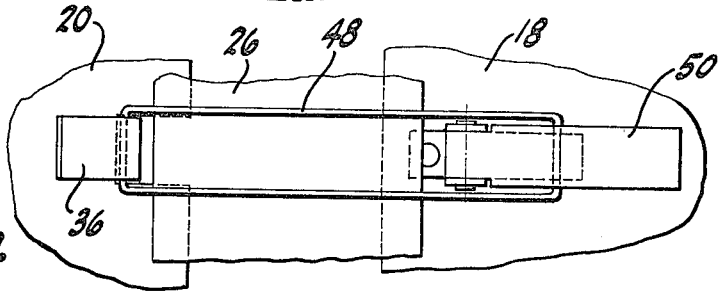
FIG. 4 is a fragmentary elevational view taken along the line 4—4 of FIG. 3.

Unit 10 includes an inner boot 12 which preferably is of the cross-country type having a leather upper. The boot is relatively light weight and permits the foot to flex fore and aft when striding on the ski in the Nordic mode. An outer rigid shell 14 which can be of molded plastic is detachably mounted about the inner boot. The shell includes a heel support or base 16 joined to a pair of sidewalls 18, 20 which extend upwardly in a snug fit along the sides of the boot. The heel support lifts the heel of the inner boot to provide a forward lean for the skier. A layer of soft padding 22 is attached to the inside of the shell, as shown in FIG. 3.

Figure 5:
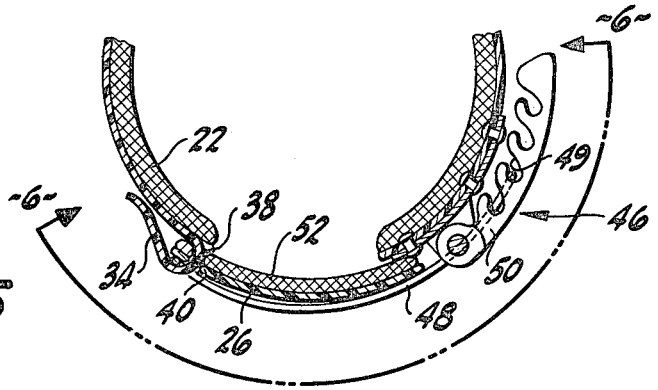
FIG. 5 is a fragmentary cross-sectional view of the top and bottom buckles taken along the line 5—5 of FIG. 1.
Figure 6:
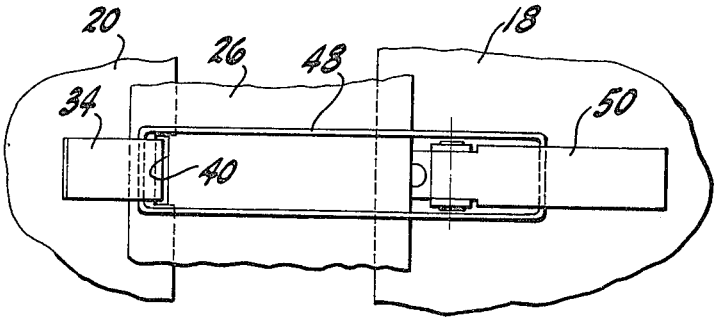
FIG. 6 is a fragmentary elevational view taken along the line 6—6 of FIG. 5.

The shell includes a tongue 24 having an arcuate upper portion 26 which bridges across the front lacing of the inner boot and overlaps the forward edges of the shell sidewalls. A lower portion 28 of the tongue extends over the toe 30 of the boot, and the upper and lower portions are joined by an intermediate portion 32 which is flexible to permit forward safety release of the boot when the "heel binding releases during skiing. The upper portion of the tongue is carried on the shell by means of three clips 34, 36 which are comprised of strips formed integral with shell sidewall 20 and which are curved backwardly from the forward edge 38, as illustrated in FIGS. 3 and 5. A pair of vertical slots 40 are formed in the tongue adjacent the upper and lower clips, and these two clips are engaged through the slots so as to hold the tongue in position and permit it to pivot open and closed.

Three buckles 42, 44 and 46 are provided to releasably secure the tongue and shell about the boot. Each of the three buckles includes a wire-form arcuate bail 48 having one end engaged in the associated clip and the other end adapted for selective engagement with one of a series of notches 49 formed in a detent 50 which is pivotally attached to shell sidewall 18. A layer of soft padding 52 is affixed to the inside surface of the upper tongue portion.

The invention includes a heel binding 54 and toe binding 56 for releasably clamping or holding unit 10 to the ski. The heel binding includes a plunger 58 which is mounted for axial sliding movement through an opening 60 formed in the rear of shell base 16. The plunger is yieldably urged outwardly by means of a stiff compression spring 62 carried within a chamber 64 in the base. A threaded cap 66 mounted at the end of the housing retains the spring and plunger, and an access hole 68 is formed at the base of the shell to permit insertion and removal of the spring and plunger.

The heel binding further includes an L-shaped detent 70 having a flat heel plate 72 which is secured by fasteners to the top of the ski. A flat pad 74 of a suitable plastics material such as Teflon is secured to the top of the heel plate. A notch 76 is formed on the inside of the detent for seating the rounded end of plunger 58, and a chamfer 78 is formed at the top of the detent to facilitate latching of the plunger into the notch. When the heel binding is latched the heel of the unit is firmly held for downhill skiing, yet when excessive stresses are encountered such as during a fall the plunger yields and quickly releases the heel from the ski. In the invention the weight of the plunger and spring elements of the binding is aligned below the heel for optimum weight distribution of the ski, allowing the ski to be balanced in the Nordic mode.

Figure 2:
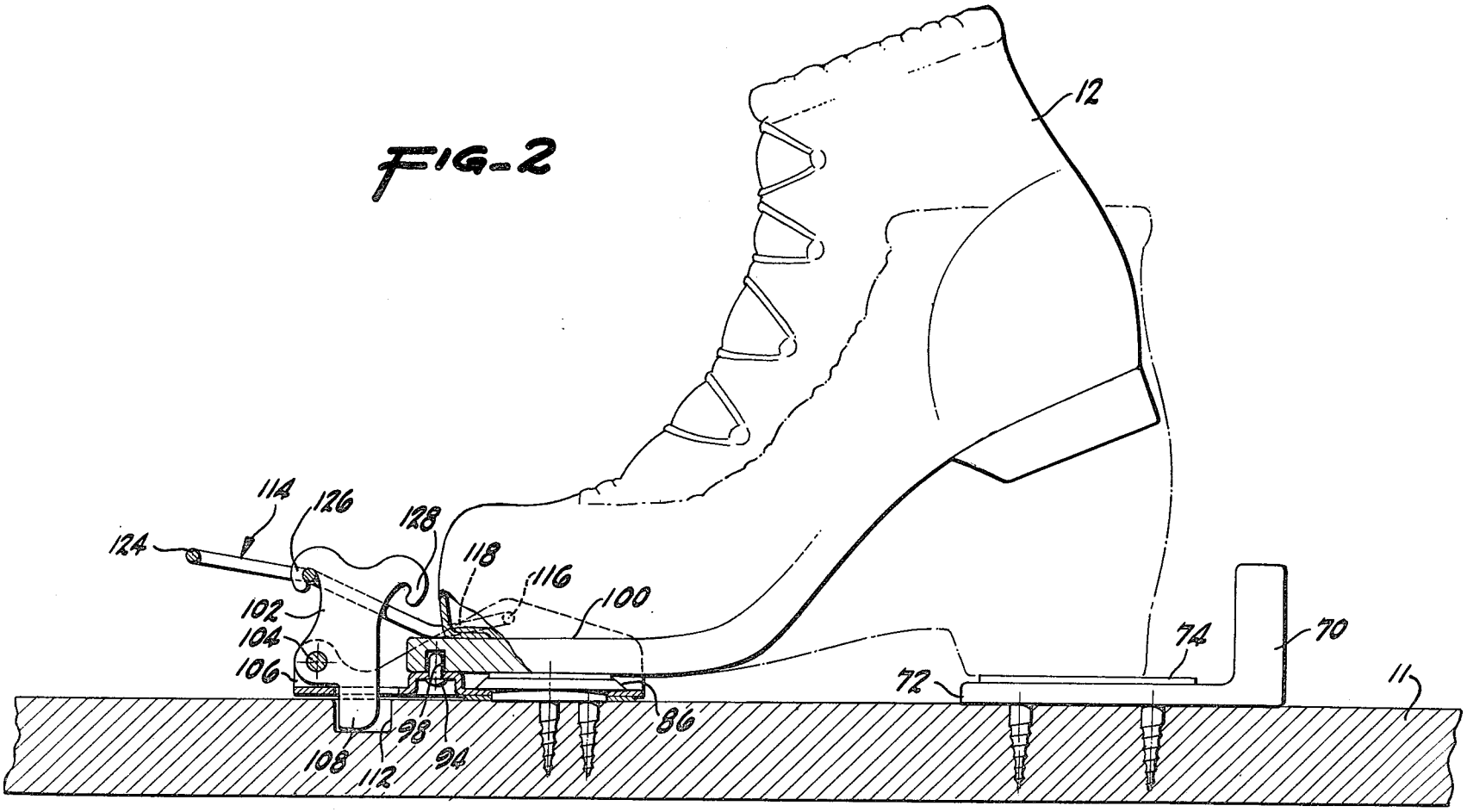
FIG. 2 is a side elevational view similar to FIG. 1 and showing the equipment in the Nordic mode of use.

Toe binding 56 includes a metal toe plate 80 formed with a pair of sidewalls 82, 84 which diverge apart rearwardly for receiving the toe of the boot in the manner illustrated in FIG. 7. A metal baseplate 86 having a circular rim 88 is secured by fasteners to the top of the ski. A circular opening 90 formed in the bottom of the toe plate fits under the rim of the baseplate so as to mount the toe plate for pivotal movement about a vertical axis. Mounted above the baseplate is a flat pad 92 formed of a suitable plastics material such as Teflon. A plurality of studs 94 are mounted in an upwardly turned portion 96 of the toe plate, and the studs project upwardly to seat in openings 98 (FIG. 2) formed in the toe portion of the boot sole 100. The studs serve to position and hold the sole in the toe plate.

Locking means is provided for locking the toe plate to prevent it from rotating during the Nordic mode of use. The locking means includes an upstanding hook 102 mounted for rotation on a laterally extending pin 104 which in turn is carried on a hook support 106 formed integral with the toe plate. A nose 108 at the lower end of the hook is adapted to extend downwardly through a slot 110 in the support for engaging a hole 112 formed in the upper surface of the ski in the manner illustrated in FIG. 2. During the Alpine mode the hook is pivoted to the position of FIG. 1 where the nose is raised out of engagement with the hole in the ski.

Latch means is provided for releasably holding the toe of the boot in the toe plate during both the Alpine and Nordic modes of use. The latch means includes a wire-formed bail 114 pivotally mounted at 116 to opposite sides 82, 84 of the toe plate. Inwardly extending portions 118, 120 of the bail overlie the upper surface of the toe portion of boot sole 100, and a forwardly extending portion of the bail is formed with a horizontally extending axle 122 together with an operating arm 124. The hook includes a forward detent 126 which is positioned to engage the axle when the hook is positioned as in FIG. 2 for the Nordic mode. A rearward detent 128 is formed on the hook for engaging the axle when the hook is in the position of FIG. 1 for the Alpine mode. In the Nordic mode with the hook and bail engaged together as in FIG. 2, the inwardly extending portions 118, 120 of the bail compress downwardly against the toe portion of the heel sole to firmly seat the toe in the toe plate. In the Alpine mode with the hook engaged on the bail in the manner in FIG. 1, the inwardly extending portions of the bail compress downwardly against a curved rim 130 on the lower portion 28 of the tongue which in turn compresses against the toe portion of the boot sole thereby seating the toe in the toe plate. The latch means is released from either mode by the skier pushing down on bail arm 124 to release the detents from axle 122 and then by pivoting the bail clockwise as viewed in FIG. 1.

The use and operation of the invention are as follows. For use in Alpine or downhill skiing the skier inserts inner boot 12 within the sidewalls of shell 14, pivots tongue 24 across the front of the boot, and latches the buckles by engaging the bails with detents 50. The toe of the boot is then inserted into toe plate 80 with the studs 94 inserted in the sole. At the same time the heel is pushed down into heel binding 54 so that plunger 58 releasably engages in detent 76. Hook 102 is pivoted forward to the position of FIG. 1 and the bail is pushed downwardly to engage detent 128 while simultaneously compressing the lower portion of tongue 24 downwardly to seat the toe. The equipment is now used for downhill skiing. Should any excessive forces be encountered, such as during a fall, the heel is released as the plunger yields and releases from the detent. When the heel releases the toe is free to pivot and release because toe plate 88 is free to pivot about baseplate 86.

For converting the unit to Nordic or cross-country use, the skier can quickly detach shell 14 by releasing the buckles. The toe of the boot is then inserted in the toe plate with the studs 94 engaged with the sole in the manner shown in FIG. 2. The skier pivots hook 102 rearwardly so that nose 108 engages hole 112 to lock the toe plate against rotation. The arm 124 of the bail is then pushed down so that axle 122 engages detent 126 while at the same time the bail compresses against the boot sole to firmly seat the toe. The equipment can now be used in the cross-country mode with the heel free to move up and down as the skier strides. Moreover, during cross-country skiing the skier can carry the detached shells in a pack on his back, for example, thereby making it easier to carry this weight than if the shells remained on his feet. When in use over varied ski terrain the equipment can be easily converted back and forth between the different modes.

While the foregoing embodiments are at present considered to be preferred it is understood that numerous variations and modifications may be made therein by those skilled in the art and it is intended to cover in the appended claims all such variations and modifications as fall within the true spirit and scope of the invention.

What is claimed is:

1. Combination ski boot and binding equipment for use with boots of the tour skiing type, including the combination of a ski boot shell, means for detachably mounting the shell about the boot for use during Alpine skiing and when the shell is detached the heel of the boot is released from the skii for use during tour skiing, heel binding means for releasably holding the heel of the shell on the ski for use during Alpine skiing, toe binding means operable between a first mode for releasably holding the toe of the boot on the ski for use during Alpine skiing and a second mode for locking the toe of the boot on the ski for use during tour skiing, said shell including a support for the heel of the boot and upstanding substantially rigid sides for supporting the sides of the boot, together with a tongue having an upper portion extending across the front of the boot and overlapping with the sides of the shell, said tongue including a lower portion extending over the toe of the boot and with the toe binding means locking the tongue lower portion.

2. Ski boot equipment for use in converting ski boots and bindings on a ski between tour skiing and Alpine skiing modes, the equipment including an outer shell for supporting the rear and side of a touring-type ski boot, the shell including a base for supporting the heel of the boot, means for detachably securing the shell about the ski boot for use in the Alpine mode when the toe of the boot is releasably held on the ski, binding means carried by the shell base for releasably holding the shell and thereby the boot on the ski during the Alpine mode, with the boot when the shell is detached therefrom having its toe locked on the ski and its heel free to move relative to the ski, said shell including a pair of sidewalls which extend upwardly along the sides of the ski boot with forward edges of the sidewalls being spaced apart to permit insertion and removal of the boot between the sidewalls, together with an elongate tongue having an upper portion bridging across the forward edges of the sidewalls for supporting the front of the boot in the Alpine mode, the tongue including a lower portion extending in overlapping relationship with the toe of the boot and with the tongue lower portion being held by the toe binding on the ski, said upper and lower portions of the tongue being joined by a flexible intermediate portion.

3. Ski boot equipment for use in converting ski boots and bindings on a ski between tour skiing and Alpine skiing modes, the equipment including an outer shell for supporting the rear and side of a touring-type ski boot, the shell including a base for supporting the heel of the boot, means for detachably securing the shell about the ski boot for use in the Alpine mode when the toe of the boot is releasably held on the ski, binding means carried by the shell base for releasably holding the shell and thereby the boot on the ski during the Alpine mode, with the boot when the shell is detached therefrom having its toe locked on the ski and its heel free to move relative to the ski, said shell including a pair of sidewalls which extend upwardly along the sides of the ski boot with forward edges of the sidewalls being spaced apart to permit insertion and removal of the boot between the sidewalls, together with an elongate tongue having an upper portion bridging across the forward edges of the sidewalls for supporting the front of the boot in the Alpine mode, including clip means for pivotally holding a side of the tongue on a sidewall of the shell, together with releasable latch means secured between forward edges of the sidewalls and extending across the tongue.

4. A ski binding for use with a ski and ski boot equipment which is convertible between Alpine and tour skiing modes, including heel binding means for releasably holding a heel portion of the boot on the ski during the Alpine mode and for permitting free movement of the heel portion relative to the ski during the touring mode, toe binding means including a toe plate for seating the toe of the boot, locking means for rigidly holding the plate and thereby the toe of the boot on the ski during the touring mode and for permitting movement of the toe plate relative to the ski when the heel of the boot releases from the ski under high stresses during the Alpine mode, including latch means for holding the toe of the boot seated in the toe plate during the Alpine and touring modes, means for mounting the toe plate on the ski for rotation about a vertical axis to provide said movement of the toe plate during the Alpine mode, said locking means including a hook pivotally mounted on the toe plate between first and second positions with the hook extending downwardly in the first position for engaging the ski to prevent rotation of the toe plate and with the hook in the second position disengaged from the ski to permit and rotation, said latch means further including a bail pivotally mounted at its proximal end on the toe plate and extending forwardly therefrom for releasably engaging the hook, said bail when engaged with the hook overlying a portion of the toe of the boot for seating the same in the toe plate.

5. A ski binding as in claim 4 in which the hook is pivotally mounted on the toe plate, and the hook is formed with first and second detents with the first detent releasably engaging the bail when the hook is engaged with the ski and the second detent releasably engaging the bail when the hook is disengaged from the ski.

* * * * *